US005393127A

United States Patent [19]

Kimball, II

[11] Patent Number: 5,393,127

[45] Date of Patent: Feb. 28, 1995

[54] METHOD AND APPARATUS FOR RUBBLIZING AND BREAKING CONCRETE

[76] Inventor: Richard D. Kimball, II, 6137 Green Rd., Haslett, Mich. 48840

[21] Appl. No.: 215,611

[22] Filed: Mar. 22, 1994

[51] Int. Cl.[6] ..... E01C 23/12

[52] U.S. Cl. ..... 299/37; 173/100

[58] Field of Search ..... 299/37, 69, 94; 404/90; 173/89, 94, 100, 202, 210, 211

[56] References Cited

U.S. PATENT DOCUMENTS

| | | | |
|---|---|---|---|
| 2,350,223 | 5/1944 | Gedge | 173/25 |
| 2,425,018 | 8/1947 | Williams | 299/37 |
| 2,903,949 | 9/1959 | Simmonds | 173/194 |
| 4,984,639 | 1/1991 | Lindsey et al. | 173/100 |
| 5,234,282 | 8/1993 | Osborn | 299/37 X |

FOREIGN PATENT DOCUMENTS

| | | | |
|---|---|---|---|
| 986315 | 3/1965 | United Kingdom | 299/37 |
| 1393806 | 5/1975 | United Kingdom | 299/37 |

*Primary Examiner*—David J. Bagnell

*Attorney, Agent, or Firm*—Beaman & Beaman

[57] ABSTRACT

The method and apparatus for mechanically rubblizing or breaking concrete wherein a plurality of weighted hammers are mounted upon spring biased cantilevered arms attached to a pivoted frame. Upon pivoting of the frame in an impact direction, the hammers simultaneously engage the concrete producing a linear rubblizing or breaking impact zone wherein the proximity of adjacent hammers permits adjacent hammers to multiply the rubblizing and breaking forces and vibrations such that the plurality of hammers operating together simultaneously provide improved concrete rubblizing or breaking characteristics.

9 Claims, 2 Drawing Sheets

METHOD AND APPARATUS FOR RUBBLIZING AND BREAKING CONCRETE

BACKGROUND OF THE INVENTION

1. Field of the Invention

The invention pertains to a method and apparatus for mechanically rubblizing or breaking concrete by striking the concrete with weighted hammers with a controlled force impact, a plurality of hammers being mounted upon cantilevered spring arms.

2. Description of the Related Art

Concrete highways and other concrete structures may require replacing, and to remove existing concrete paving, floors and the like, it is necessary to break the concrete into pieces for removal and handling. Often, the concrete includes steel reinforcing bars and mesh, and the equipment used to break up concrete pavement and floors may include compressed air driven jack hammers or a heavy hammer or weight lifted and permitted to fall upon the concrete to crack the same into pieces for handling.

When breaking up concrete using heavy equipment as by gravity dropping heavy weights upon the concrete, which is a typical type of apparatus used with highway demolition, the forces imposed upon the concrete and the supporting substructure are often so great as to damage the substructure and installations buried therebelow, such as drain conduits, underground utility pipes or installation, bridge slabs, or the like.

In those instances wherein the substrata is to be protected, and the breaking of the concrete is to be closely controlled, the concrete breakage may be specified as being "rubblized". Rubblizing is a specific type of concrete demolition wherein the forces imposed upon the concrete to produce breakage are controlled so that the demolished pavement and broken pieces are not displaced downwardly, and in rubblizing, the broken concrete must be free of the reinforcement located therein, and the sizes of the concrete particles, after rubblizing, are usually no greater than approximately eight inches in dimension. Rubblized concrete may be rolled and compacted and remain in place as a base for newly poured concrete pavement and floors in view of the small particles provided. Proper rubblizing to meet specifications cannot be mechanically produced by the dropping of a conventional heavy weight upon concrete, and the use of conventional drop hammers is not practical for rubblizing in that the size of the particles required are smaller than can be effectively and efficiently produced by drop hammer type breakers.

Presently, most concrete rubblizing is produced by powerful sonic vibrators generating sonic vibrations in the rigid concrete which will pulverize the concrete, free the reinforcing steel therefrom, and produce the small size particles desired. However, sonic vibrations can only be applied to limited areas of the concrete at a given time, and rubblizing by sonic equipment is slow, expensive, and unreliable as the sonic generators require constant maintenance.

Rubblizing by a mechanical hammer wherein the impact imposed upon the concrete structure can be closely controlled is known, and the demolition hammer shown in U.S. Pat. No. 4,984,639 is capable of mechanically rubblizing concrete. The demolition hammer shown in this patent consists of a cantilever spring arm having a weight at the arm outer end, and the inner end of the arm is mounted upon movable structure, such as a backhoe, wherein the movement of the arm and hammer may be hydraulically controlled and regulated, and in this manner, the impact forces imposed upon the concrete are closely controlled. Because of the mounting of the hammer upon a spring arm, high frequency vibrations are imposed upon the concrete which produce a rubblizing action. However, the apparatus shown in U.S. Pat. No. 4,984,639 is usually not used for concrete rubblizing purposes in that it is too slow and tedious as each hammer blow must be aimed and regulated, and a high production of concrete rubblizing cannot be achieved with the apparatus disclosed.

It is known to mount a plurality of hammers or breaking heads upon concrete breaking apparatus or similar equipment, and typical devices of this type are shown in U.S. Pat. Nos. 2,350,223; 2,425,018 and 2,903,949. However, such devices are not suitable for high production concrete rubblizing, and the hammers of such devices are not related to each other in such a manner to permit the breaking impact vibrations produced by one hammer at its impact zone to be effectively transferred to the impact zone of an adjacent hammer wherein a high production concrete rubblizing operation can be achieved.

OBJECTS OF THE INVENTION

It is an object of the invention to provide a method and apparatus for rubblizing or breaking concrete wherein a plurality of spring biased cantilevered spring arms are employed, a hammer being located upon the spring arms' outer ends, and the hammers simultaneously engaging the concrete surface to be rubblized in such a manner that the effect of a plurality of hammers simultaneously engaging the concrete produces a multiplication of the rubblizing impact force wherein the combined result is greater than that achieved by each hammer individually.

Another object of the invention is to provide a method and apparatus for rubblizing or breaking concrete wherein relatively inexpensive mechanical apparatus is capable of rubblizing relatively large areas of concrete at minimal cost in a short time.

An additional object of the invention is to provide a method and apparatus for mechanically rubblizing concrete wherein the apparatus may be mounted upon a conventional heavy duty construction vehicle, and the operation of the apparatus may be provided by a vehicle operator of ordinary skills and cycling of the apparatus may be automatic.

SUMMARY OF THE INVENTION

In the practice of the invention, an elongated frame is pivotally mounted upon a heavy duty construction vehicle wherein the frame is capable of being quickly rotated about its pivot axis by a vehicle mounted hydraulic cylinder. The frame is pivotally oscillated between an impact producing direction and a hammer retracting direction.

The frame supports a plurality of cantilevered spring arms extending from the front side of the frame whose length is perpendicularly disposed to the frame pivot axis. The inner end of the spring arm is pivotally mounted upon the frame, and the outer end of each spring arm supports a weighted hammer having a striking face of a rectangular configuration. A compression spring mounted upon the frame and spaced from the associated arm pivot axis, biases the arm outer end in the direction of frame impact producing rotation.

The hammers mounted upon each spring arm outer end are disposed in a side-by-side relationship to each other, and the arms are all of equal length wherein the hammers will define a linear configuration forming a linear rubblizing or breaking impact zone. The rectangular configuration of the striking face of each hammer places the ends of adjacent hammer's striking faces in close proximity, and the corners of the striking faces are sharp or abrupt wherein the plurality of hammers, eight in the preferred embodiment, together define an elongated linear concrete engaging zone whose entire area is simultaneously exposed to impact from the eight hammers.

As the hammers are spring mounted, the rapid pivoting of the frame in an impact producing direction causes the hammers to be rapidly brought into engagement with the concrete to be rubblized. Such movement of the spring arms and hammers in an impact producing direction will produce a partial compression of the springs associated with the arms, and upon engagement of the hammers with the concrete the recoil or bounce-back action on the arms will be transferred to the associated arm springs and a plurality of very rapid vibrations are imposed upon the hammers producing the desired rubblizing hammer vibration and action. As the entire linear rubblizing impact zone defined by the hammers is simultaneously subjected to the impact of the hammers, a relatively large area is simultaneously rubblized and the cycle can be repeated at the same location if smaller concrete particles are desired.

An important aspect of the invention results from the close proximity of adjacent hammers, as the impact forces and vibrations imposed upon the concrete by a single hammer radiates outwardly from the hammer impact zone and will enter the impact zone of the adjacent hammer. The impact force vibrations of the hammers will laterally radiate into the impact zone of adjacent hammers, and the direction of the vibrations imposed upon the concrete from a plurality of hammers simultaneously striking the concrete produces a more effective rubblizing force than is achieved by using a single hammer such as shown in U.S. Pat. No. 4,984,639.

As the striking faces of the hammer are preferably rectangular having sharp or abrupt edges, such hammer edges will create high stress locations in the concrete which aid in the rubblizing, and in the practice of the invention the force by which the hammers simultaneously engage the concrete can be accurately controlled wherein rubblizing forces and vibrations are mechanically generated capable of preventing damage to the substrata, and yet permitting the concrete to be broken up into small pieces free of the reinforcement. The power required to produce mechanical rubblizing using the concepts of the invention is much less than with other rubblizing techniques, and utilizing the concepts of the invention permits a much higher production of the rubblizing of concrete at a lower cost than heretofore achieved.

It is to be understood that in the description of the invention, and in the claims, the "rubblizing" of concrete describes the reducing of the concrete to small particles which may not necessarily be removed from the site but may be rolled and compacted into the substrata to form the base for a new pouring of concrete, while "breaking" of concrete refers to the forming of concrete particles of larger size which are usually removed from the site prior to a new pouring. The method and apparatus of the invention can be used to both break and rubblize concrete as determined by the hammer stroke or repeated impact at the same location. Hereinafter, the term "rubblizing" will be used to describe the invention, but it is to be understood that this term also includes the "breaking" of concrete.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
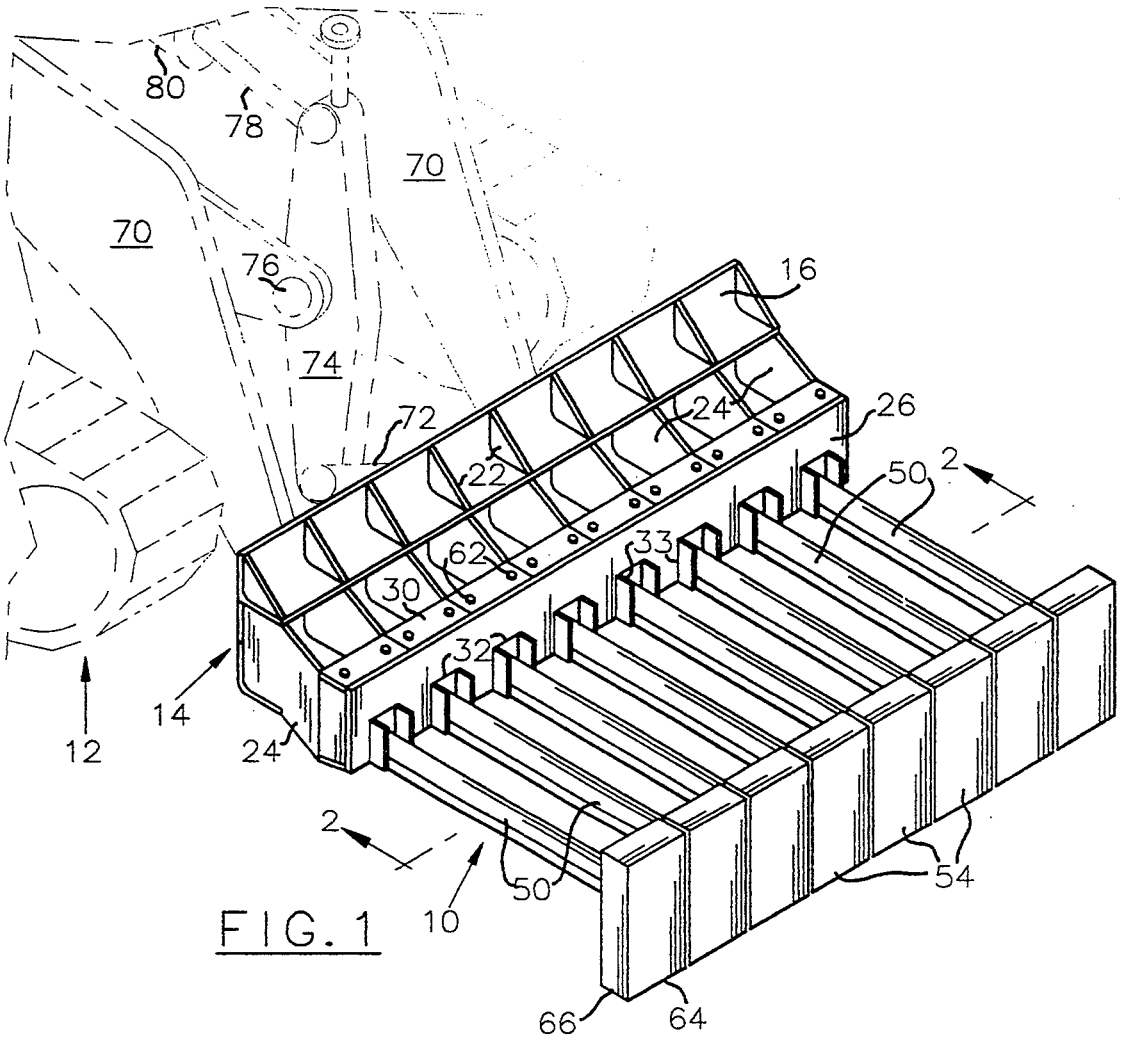
FIG. 1 is a perspective view of rubblizing apparatus in accord with the invention as mounted upon a heavy duty tractor shown in dotted lines.
Figure 2:
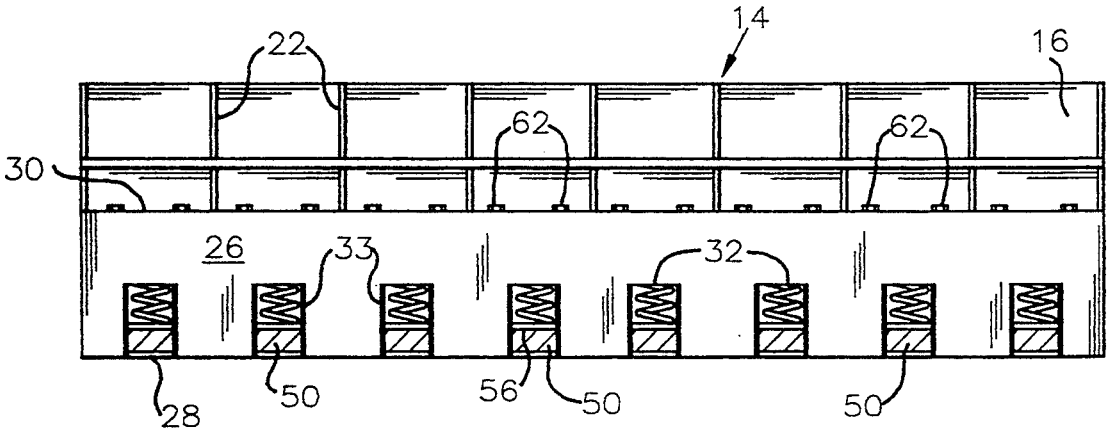
FIG. 2 is an elevational sectional view of the rubblizing apparatus, per se, as taken along Section 2—2 of FIG. 1.

With reference to FIG. 1, the rubblizer apparatus is generally indicated at 10, and this apparatus is mounted upon a heavy duty construction vehicle such as a crawler tractor or the like, indicated in dotted lines at 12. It is to be understood that the rubblizer 10 could be mounted upon a variety of types of construction vehicles, the requirement being that the vehicle be large and powerful enough to support the rubblizer and produce the desired rubblizer pivoting movement during concrete rubblizing.

The rubblizer primary component is an elongated frame 14 having a longitudinal length and axis transversely disposed to the normal direction of movement of the tractor 12. The frame 14 comprises a high strength rigid structure, and may be fabricated of a heavy duty upper angle iron element 16, and a heavy duty lower angle iron element 18, both of which extend the length of the frame.

Plate back pieces 20 are welded between the elements 16 and 18, and gussets 22 welded between the arms of the upper angle iron 16 strengthen the element 16.

Figure 3:
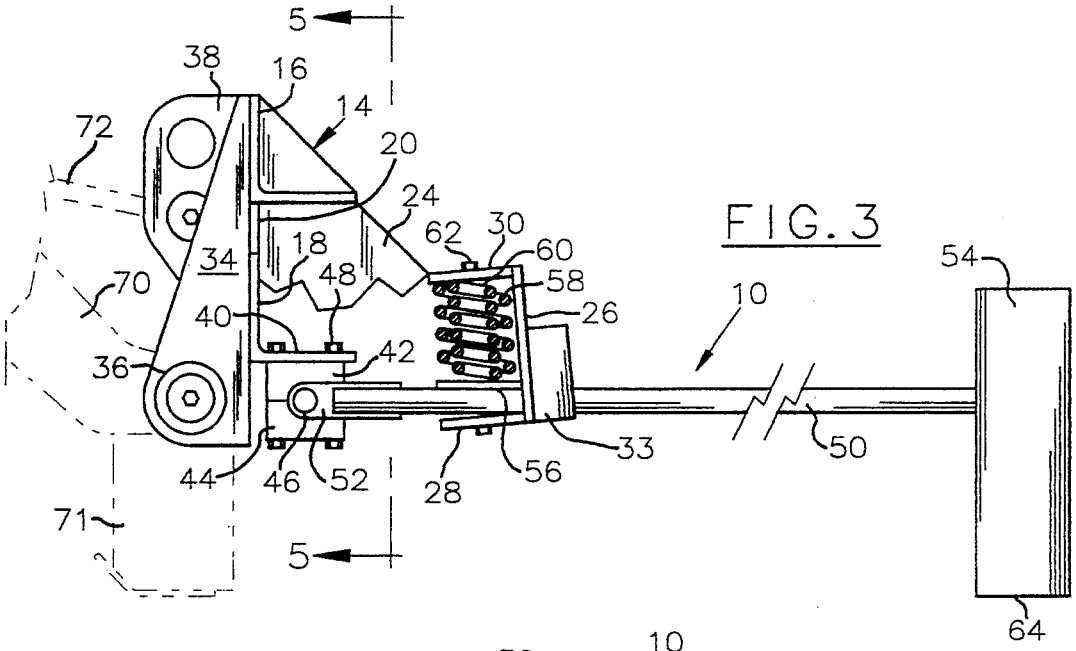
FIG. 3 is a side elevational view of the rubblizing apparatus, the supporting vehicle and components being shown in dotted lines, and the apparatus being partially broken away to illustrate the support of the cantilever spring arms and the compression springs bearing upon the arms.
Figure 4:
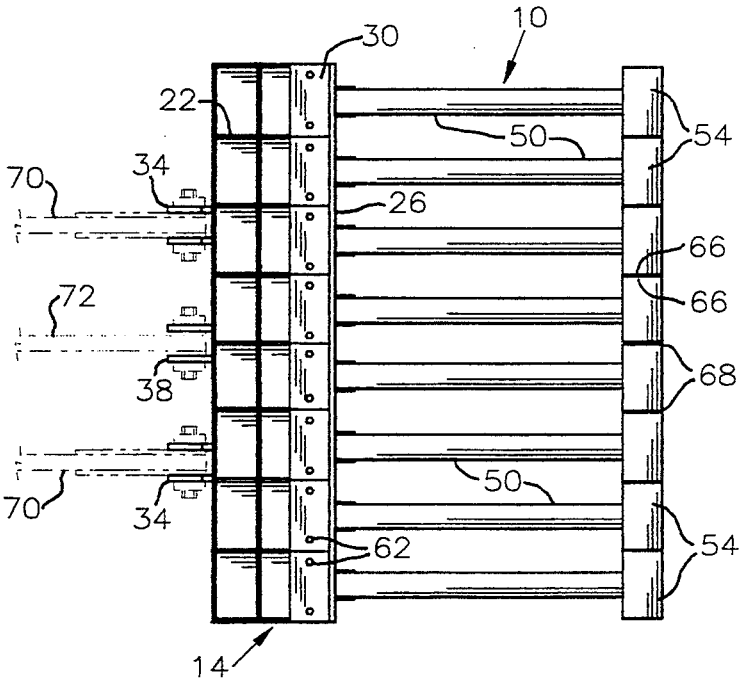
FIG. 4 is a top plan view of the apparatus of the invention.

Heavy duty steel plate brackets 24, such as formed of one inch boiler plate, are welded to the underside of the lower flange of the angle iron 16 and the brackets 24 extend forwardly and downwardly as will be appreciated from FIG. 3. A front plate 26 is welded across the front of the brackets 24, and the brackets 24 include substantially horizontal surfaces which support a lower plate 28 and an upper plate 30 held together by bolts, as later described. Eight rectangular openings 32 are provided in the front plate 26, and upon each lateral side of the openings 32, a spring arm guide 33 is located for a purpose later described.

The supporting structure for the frame 14 is located upon the back of the angle irons 16 and 18, and the back pieces 20. Such supporting brackets include two sets of main pivot brackets 34 each including a pivot receiving bearing 36, and the pivoting of the frame 14 is accomplished through a central bracket 38 to which an actuator rod is attached, as later described.

The lower flange 40 of the lower angle iron 18 is used to support the split bearing blocks for the spring arms. These bearing blocks include an upper block 42, and a lower block 44, each having one-half of a cylindrical recess defined therein for receiving a spring arm pivot pin 46. Bolts 48 extending through the flange 40 and bearing blocks 42 and 44 maintain the assembly affixed to the flange 40.

Figure 5:
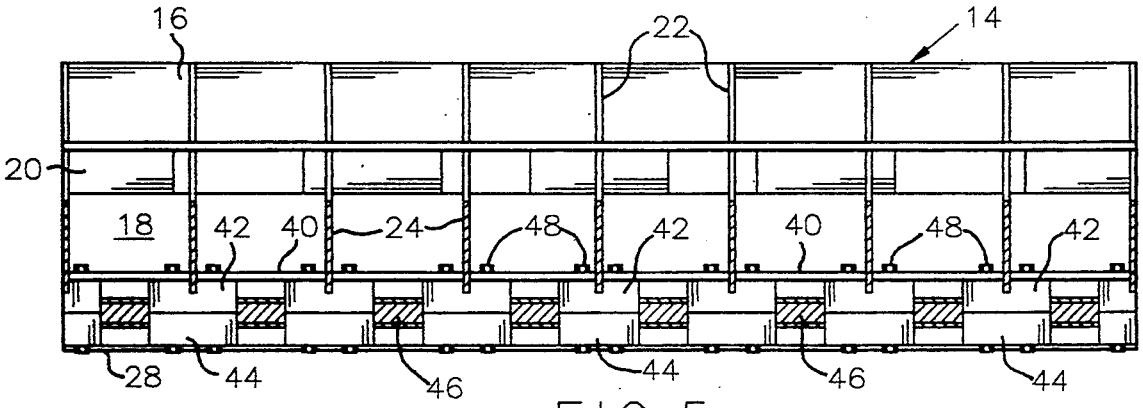
FIG. 5 is an elevational sectional view taken through the rubblizing apparatus along Section 5—5 of FIG. 3.

Eight cantilevered spring arms 50 are mounted upon the frame 14, each being mounted upon a pivot pin 46 and bearing blocks 42 and 44 as will be appreciated from FIG. 5. The spring arms 50 are formed of steel, and are relatively slender having the ability to bend or deflect within their range of elasticity, and the inner end of the arms 50 is provided with a pivot connection 52 bolted thereon which receives the pivot pin 46 attaching the inner end of the arms 50 to the frame 14.

At its outer free end, the spring arms 50 each support a steel weight 54 which constitutes a solid steel hammer. Each spring arm 50 is biased downwardly by spring structure which includes a wear plate 56 mounted upon the upper portion of the arm within the frame 14, and a large compression spring 58 having a smaller compression spring 60 located therein is located between the plate 56 and the frame upper plate 30. Bolts 62 extending through the upper plate 30 and the lower plate 28 permit the upper plates 30 to be maintained in position compressing the springs 58 and 60, and downward movement of the spring arms 50 is limited by engagement of the arms with the frame lower plate 28, as will be appreciated from FIG. 3.

The striking face of the hammers 54 is represented at 64 and is of a rectangular configuration defined by ends 66 and corners 68. As will be appreciated from the drawings, the pivot pins 46 for the spring arms 50 are all coaxial, and the length of the spring arms 50 are equal. Therefore, as the configuration of the hammers 54 are identical, the hammers 54 are disposed in a linear manner, and together define a linear impact zone or area during rubblizing. It is to be understood that the hammers 54 are not interconnected, and each is free to strike and oscillate on its own, but because all eight arms 50 are identical the hammers 54, together, will be aligned in a side-by-side relationship as shown in the figures and form an elongated impact zone.

As will be apparent from FIGS. 1 and 3, the tractor 12 includes a pair of mounting arms 70 which are raised and lowered by hydraulic cylinders, not shown, and the arms 70 are pivotally attached to frame brackets 34 whereby the arms 70 may be raised and lowered to raise and lower the rubblizer 10. A ground engaging rest 71, FIG. 3, is formed upon the lower side of the arms 70 which may engage the support surface, i.e. the concrete structure being rubblized, to properly position the frame 14 during operation. Pivot pins extending through the pivot bearings 36 interconnect the brackets 34 to the vehicle arms 70.

The frame center bracket 38 is connected to the actuating rod 72 and the rod 72 is pivotally connected to the lower end of a lever 74 pivotally mounted on the vehicle 12 at 76. The lever 74 is pivoted by a piston rod 78 extending from hydraulic cylinder 80, and as it will be appreciated that the connection of the rod 72 to the frame 14 is well above the pivot bearings 36, extension and retraction of the rod 72 as produced by cylinder 80 and piston rod 78 will pivot the rubblizer 10 about the pivot bearings 36.

In operation, the vehicle arms 70 will be sufficiently raised to lift the rubblizer 10 above the terrain and permit the rubblizer to be transported to the desired location. The tractor 12 will locate the rubblizer 10 upon the concrete pavement, or the like, to be rubblized such that the hammers 54 will be positioned on the concrete location to be demolished. The arms 70 are then lowered until the rest 71 engages the concrete. Thereupon, the rod 72 is retracted to the left, FIG. 3, which will pivot the frame 14 counterclockwise about pivot bearings 36 and raise the hammers 54 in view of the fact that the hammer arms 50 are engaging the bracket lower plate 28. The rod 72 will be retracted until the hammers 54 are positioned above the concrete the desired distance, and then the piston rod 78 will be rapidly retracted pivoting the lever 74 and extending rod 72 to pivot the frame 14 clockwise, FIG. 3, momentarily compressing the springs 58 and 60 to overcome the inertia of the weight of the hammers 54. This clockwise rotation of the frame 14 will cause the hammers 54 to rapidly descend and engage the concrete to be rubblized. All of the hammers 54 will simultaneously engage the concrete and a controlled rubblizing impact is automatically imposed thereon.

The clockwise rotation of the frame 14 produces a whip-like movement of the hammers 54 and a sharp impact between the hammer faces 64 and the concrete produces high frequency vibrations within the concrete which will crumble the concrete, break the concrete from the reinforcing rods or mesh, and produce the desired rubblized concrete particle dimensions. If the resulting concrete particles are not as small as desired, the impact cycle can be repeated at the same location.

Because the hammers 54 are disposed adjacent each other in a side-by-side relationship, the impact and vibration forces of each hammer will radiate into the impact and vibration zone of the adjacent hammer and the guides 33 will assure that the arms 50 remain parallel during operation of the hammers. Accordingly, in addition to the vertical vibrations being imposed upon the concrete, the adjacent hammers will impose lateral vibrations into the impact zone of adjacent hammers which further tends to demolish the concrete into small particles. Further, the abrupt hammer corners 68 will produce stress locations in the concrete which further aid in the fracturing thereof.

In the preferred embodiment, eight arms 50 and hammers 54 are employed. Each of the hammers 54 has a length transverse to the length of the associated arm 50 in excess of one foot, and apparatus in accord with the present disclosure is capable of rubblizing approximately one conventional pavement lane across its width. It is to be appreciated that a greater number of hammers than those disclosed could be mounted upon the frame 14 upon a large enough vehicle 12 being utilized having sufficient hydraulic capacity, and apparatus as wide as two widths of pavement lanes, or greater, is possible. As the rubblizing occurs hammer strokes may be repeated or the vehicle 12 may be moved between successive hammer strokes, and the apparatus of the invention permits a greater square footage of concrete to be rubblized in a given duration of time than heretofore possible with other equipment, including sonic rubblizers. The ability to closely control the force at which the hammers 54 engage the concrete permits a true rubblizing action to be controlled which does not harm components buried below the concrete, and the high frequency vibrations produced by the hammers due to their mounting upon the elongated arms 50, and the presence of the springs 58 and 60 reduces the concrete to the small dimensions required to meet rubblizing specifications.

If it is desired to use the invention for the breaking of concrete into larger particles than when rubblizing, the hammers 54 need not be raised as high or lowered as quickly as during rubblizing, and yet the cumulative effect of the adjacent hammers will provide the efficient breaking of the concrete into large particles without damage to the substrata which may be removed from the site.

It is appreciated that various modifications to the inventive concepts may be apparent to those skilled in the art without departing from the spirit and scope of the invention.

I claim:

1. The method of mechanically rubblizing concrete wherein the concrete is to be broken into relatively small particles without damage to the supporting substrata, comprising the steps of striking the concrete to be rubblized by a plurality of spring biased hammers, each hammer producing an impact zone wherein concrete breaking forces are produced, each hammer being immediately adjacent to another hammer and all the hammers simultaneously striking the concrete whereby the impact effect and vibrations produced at each hammer's impact zone will also occur within the impact zone of the adjacent hammer to multiply the concrete rubblizing forces produced at each hammer's impact zone.

2. The method of mechanically rubblizing concrete as in claim 1 wherein said plurality of hammers are arranged in a linear relationship defining a linear rubblizing impact zone.

3. The method of mechanically rubblizing concrete as in claim 2, at least eight hammers defining said linear rubblizing impact zone and said zone having a length at least eight feet long.

4. Apparatus for mechanically rubblizing concrete comprising, in combination, an elongated hammer support frame having a longitudinal axis, a front side, a rear side and ends, a pivot support defined on said frame having a pivot axis whereby said frame may be pivotally supported upon support structure for pivotal movement in impact producing and retracting directions about said pivot axis, said pivot axis being substantially parallel to said frame axis, a plurality of elongated cantilever spring arms mounted on said frame each having an inner end and an outer end, each spring arm having a length transversely disposed to said pivot support pivot axis, said arms' inner ends being mounted on said frame and a weighted hammer being mounted on each arm outer end having a concrete striking surface, said spring arms being mounted on said frame in a side-by-side relationship and being biased in the frame impact producing direction, said hammers of adjacent arms being immediately adjacent each other and having aligned concrete striking surfaces whereby pivoting of said frame in said impact producing direction will cause the concrete striking surfaces of said hammers to simultaneously engage the concrete to be rubblized such that the rubblizing impact force and vibrations of adjacent hammers will merge and overlap to multiply the rubblizing action.

5. In apparatus for mechanically rubblizing concrete as in claim 4, said arms extending from said frame front side.

6. In apparatus for mechanically rubblizing concrete as in claim 4, said frame pivot support being defined on said frame rear side.

7. In apparatus for mechanically rubblizing concrete as in claim 5, said arms' inner ends being pivotally mounted about pivot axes defined on said frame, and springs mounted on said frame biasing said arms in said impact producing direction, a separate spring biasing each arm.

8. In apparatus for mechanically rubblizing concrete as in claim 7, said arms' pivot axes being coaxially aligned, said arms all being of equal length whereby said hammers are linearly aligned defining an elongated linear rubblizing impact zone.

9. In apparatus for mechanically rubblizing concrete as in claim 8, said hammers' concrete striking surface being rectangular having end edges and abrupt corners, said end edges of adjacent hammers' striking surfaces being in close proximity to each other.

* * * * *